US010557186B2

(12) United States Patent
Sung et al.

(10) Patent No.: US 10,557,186 B2
(45) Date of Patent: Feb. 11, 2020

(54) WROUGHT ALUMINUM ALLOY

(71) Applicant: KOREA AUTOMOTIVE TECHNOLOGY INSTITUTE, Chungcheongnam-do (KR)

(72) Inventors: Si Young Sung, Chungcheongnam-do (KR); Beom Suck Han, Gyeonggi-do (KR); Se Hoon Kim, Chungcheongnam-do (KR); Jae Hyuk Shin, Chungcheongnam-do (KR); Jin Pyeong Kim, Chungcheongnam-do (KR)

(73) Assignee: KOREA AUTOMOTIVE TECHNOLOGY INSTITUTE, Chungcheongnam-Do (KR)

( * ) Notice: Subject to any disclaimer, the term of this patent is extended or adjusted under 35 U.S.C. 154(b) by 400 days.

(21) Appl. No.: 15/477,347

(22) Filed: Apr. 3, 2017

(65) Prior Publication Data

US 2017/0283914 A1 Oct. 5, 2017

(30) Foreign Application Priority Data

Apr. 4, 2016 (KR) ..... 10-2016-0040972
Oct. 20, 2016 (KR) ..... 10-2016-0136665

(51) Int. Cl.
*C22C 21/10* (2006.01)
*C22F 1/053* (2006.01)

(52) U.S. Cl.
CPC ..... *C22C 21/10* (2013.01); *C22F 1/053* (2013.01)

(58) Field of Classification Search
CPC ..... C22C 21/10
See application file for complete search history.

(56) References Cited

U.S. PATENT DOCUMENTS 4,711,762 A * 12/1987 Vernam ..... C22C 21/10 148/415
2008/0173377 A1 7/2008 Khosla et al.
2008/0173378 A1 7/2008 Khosla et al.
2011/0111081 A1* 5/2011 Chen ..... C22C 21/10 425/542
2012/0234440 A1 9/2012 Miyata et al.
2013/0146183 A1 6/2013 Miyata et al.
2014/0209222 A1 7/2014 Shikama et al.
2014/0209223 A1 7/2014 Hashimoto et al.
2015/0090373 A1* 4/2015 Gable ..... C22F 1/053 148/549
2015/0218679 A1* 8/2015 Aruga ..... C22C 21/10 420/532

FOREIGN PATENT DOCUMENTS

CN 104619872 A 5/2015
KR 10-2015-0038678 4/2015
WO 2008/003506 A2 1/2008

* cited by examiner

*Primary Examiner* — Anthony J Zimmer
*Assistant Examiner* — Ricardo D Morales
(74) *Attorney, Agent, or Firm* — Mayer & Williams, PC; Stuart H. Mayer

(57) ABSTRACT

Provided is a wrought aluminum alloy including 5.5 to 6.0 wt % of Zn, 2.0 to 2.5 wt % of Mg, 0.2 to 0.6 wt % of Cu, 0.1 to 0.2 wt % of Cr, at most 0.2 wt % (and more than 0 wt %) of Fe, at most 0.2 wt % (and more than 0 wt %) of Mn, at most 0.2 wt % (and more than 0 wt %) of Si, at most 0.1 wt % (and more than 0 wt %) of Ti, and at most 0.05 wt % (and more than 0 wt %) of Sr, with the remainder being Al.

11 Claims, 16 Drawing Sheets

Average YS : 510.4 MPa, TS : 555.1 MPa, El:9.93

WROUGHT ALUMINUM ALLOY

BACKGROUND

The present application relates to a wrought alloy, and more particularly, to an wrought aluminum alloy.

Extruded aluminum is being employed to impart high strength to automobile bumpers, structural materials, smartphones, IT components. Although 7000 series aluminum alloys are being employed as such extruded aluminums, such 7000 series aluminum alloys have low extrudability, and thus exhibit limitations with regard to cross section shape and reduced productivity.

That is, although 7000 series aluminum alloys have a high yield strength of 500 MPa following T6 heat treatment, and are thus widely used in applications ranging from aircraft parts and automobiles, to smartphone cases, there is a limitation in that the material has low extrudability due to having high rigidity. Moreover, there is a limitation in that deformation occurs during the T6 heat treatment. In the case of typical structural materials, deformation may be controlled through a final processing step. However, in the case of smartphones and various precision extrusion products, additional processing increases manufacturing costs, and thus reduces cost competitiveness. In addition, when producing billets using a continuous casting technique, there is a limitation in that cracks are generated during the billet manufacturing process when there is a sudden volume change of 0.3% or greater near the solidus. Thus, it is becoming increasingly necessary to develop a material in which cracks are not generated during the manufacturing of billets using a continuous casting technique, and which has excellent extrudability, exhibits low deformation during T6 heat treatment, and achieves a yield strength of at least 500 MPa following heat treatment.

SUMMARY

The present disclosure provides a wrought aluminum alloy, which is a 7000 series aluminum alloy having a yield strength of at least 500 MPa and capable of achieving an extrusion speed of at least 1 mm/s, and which is not deformed when subjected to solution treatment and press water quenching (PWQ). The present disclosure also provides an automobile bumper, a structural material, and a smartphone case which contain the wrought aluminum alloy as a material. However, these are exemplary, and the scope of the present disclosure is not limited thereby.

In accordance with an exemplary embodiment, a wrought aluminum alloy contains 5.5 to 6.0 wt % of Zn; 2.0 to 2.5 wt % of Mg; 0.2 to 0.6 wt % of Cu; 0.1 to 0.2 wt % of Cr; at most 0.2 wt % (and more than 0 wt %) of Fe; at most 0.2 wt % (and more than 0 wt %) of Mn; at most 0.2 wt % (and more than 0 wt %) of Si; at most 0.1 wt % (and more than 0 wt %) of Ti; and at most 0.05 wt % (and more than 0 wt %) of Sr, with the remainder being Al.

In accordance with another exemplary embodiment, a wrought aluminum alloy contains 5.5 to 6.0 wt % of Zn; 2.0 to 2.5 wt % of Mg; 0.2 to 0.6 wt % of Cu; 0.1 to 0.2 wt % of Cr; at most 0.2 wt % (and more than 0 wt %) of Fe; at most 0.2 wt % (and more than 0 wt %) of Mn; at most 0.2 wt % (and more than 0 wt %) of Si; and at most 0.1 wt % (and more than 0 wt %) of Ti, with the remainder being Al.

In accordance with yet another exemplary embodiment, a wrought aluminum alloy contains 5.5 to 6.0 wt % of Zn; 2.0 to 2.5 wt % of Mg; 0.2 to 0.6 wt % of Cu; 0.1 to 0.2 wt % of Cr; at most 0.2 wt % (and more than 0 wt %) of Fe; at most 0.2 wt % (and more than 0 wt %) of Mn; at most 0.2 wt % (and more than 0 wt %) of Si; at most 0.1 wt % (and more than 0 wt %) of Ti; at most 0.05 wt % (and more than 0 wt %) of Sr; and 0.1 to 0.8 wt % of Ag, with the remainder being Al.

The wrought aluminum alloy may specifically contain 0.4 to 0.6 wt % of Cu.

The wrought aluminum alloy may specifically contain 2.0 to 2.25 wt % of Mg.

In accordance with an exemplary embodiment, a wrought aluminum alloy contains 0.01 to 0.15 wt % of Ti; 0.01 to 0.2 wt % of Sr; 5.5 to 6.0 wt % of Zn; 1.8 to 2.8 wt % of Mg; 0.4 to 0.8 wt % of Cu; 0.1 to 0.2 wt % of Cr; at most 0.2 wt % (and more than 0 wt %) of Fe; at most 0.2 wt % (and more than 0 wt %) of Mn; and at most 0.2 wt % (and more than 0 wt %) of Si, with the remainder being Al.

In accordance with another exemplary embodiment, a wrought aluminum alloy contains 0.01 to 0.15 wt % of Ti; 5.5 to 6.0 wt % of Zn; 1.8 to 2.8 wt % of Mg; 0.4 to 0.8 wt % of Cu; 0.1 to 0.2 wt % of Cr; at most 0.2 wt % (and more than 0 wt %) of Fe; at most 0.2 wt % (and more than 0 wt %) of Mn; and at most 0.2 wt % (and more than 0 wt %) of Si, with the remainder being Al.

In accordance with yet another exemplary embodiment, an automobile bumper, a structural material, or a smartphone case may be provided. The automobile bumper, the structural material, or the smartphone case may include, as a material, the wrought aluminum alloy described above.

In accordance with yet another exemplary embodiment, a wrought aluminum alloy contains at least 5.5 wt % and less than 6.0 wt % of Zn; 2.0 to 2.5 wt % of Mg; 0.2 to 0.6 wt % of Cu; 0.1 to 0.2 wt % of Cr; at most 0.2 wt % (and more than 0 wt %) of Fe; at most 0.2 wt % (and more than 0 wt %) of Mn; at most 0.2 wt % (and more than 0 wt %) of Si; at most 0.1 wt % (and more than 0 wt %) of Ti; at most 0.05 wt % (and more than 0 wt %) of Sr; and 0.2 to 0.8 wt % of Ag, with the remainder being Al, wherein extrusion is possible at an extrusion speed in the range of 1.2 to 1.5 mm/s, and the yield strength is in the range of 523 to 565 MPa when T6 heat treatment is performed after the extrusion.

In accordance with yet another exemplary embodiment, a wrought aluminum alloy contains 0.01 to 0.15 wt % of Ti; 0.01 to 0.2 wt % of Sr; 5.5 to 6.0 wt % of Zn; 1.8 to 2.8 wt % of Mg; 0.4 to 0.8 wt % of Cu; 0.1 to 0.2 wt % of Cr; at most 0.2 wt % (and more than 0 wt %) of Fe; at most 0.2 wt % (and more than 0 wt %) of Mn; and at most 0.2 wt % (and more than 0 wt %) of Si, with the remainder being Al, wherein the extrusion speed is in the range of 1.0 to 1.4 mm/s.

DETAILED DESCRIPTION OF EMBODIMENTS

Figure 1:
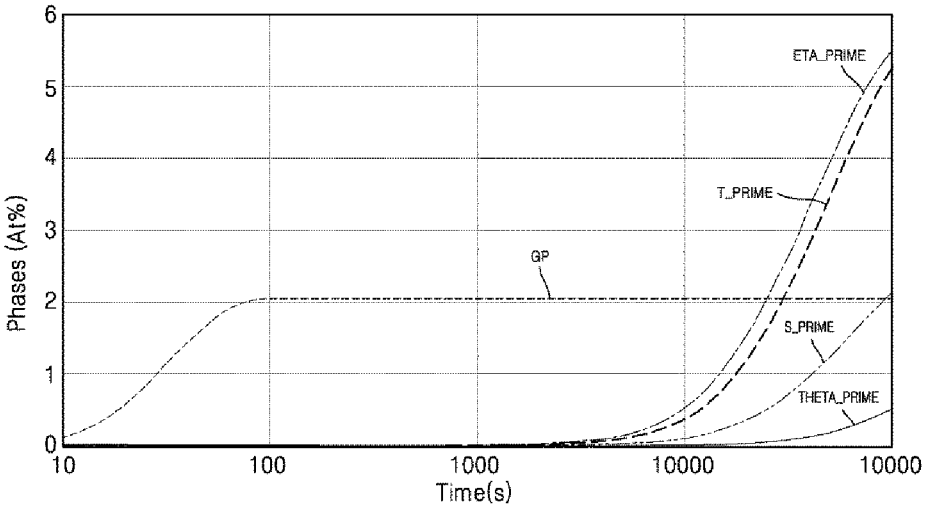
FIG. 1 is a graph analyzing phase fractions during T6 heat treatment in a wrought aluminum alloy according to a comparative example in the present disclosure.

Hereinafter, specific embodiments will be described in detail with reference to the accompanying drawings.

However, the present disclosure is not limited to the embodiments described below. Rather, the present disclosure may be realized in various other forms. The embodiments below give a more complete description of the present disclosure, and are provided in order to fully convey the scope of the disclosure to those skilled in the art. Moreover, the dimensions of elements in the drawings may be exaggerated or reduced to facilitate description thereof.

A wrought aluminum alloy (A7075), provided as a comparative example of the present disclosure, may be composed of 5.1 to 6.1 wt % of Zn; 2.1 to 2.9 wt % of Mg; 1.2 to 2.0 wt % of Cu; 0.18 to 0.28 wt % of Cr; at most 0.5 wt % of Fe; at most 0.3 wt % of Mn; at most 0.4 wt % of Si; and 0.2 wt % of Ti; with the remainder being Al.

Among wrought aluminum alloys, so-called 7000 series alloys have high yield strengths of at least 500 MPa following T6 heat treatment, and thus are widely used in applications ranging from aircraft to automobiles, and recently, smartphone cases. However, such materials have high rigidity, and thus are limited in having low extrudability. For example, when the extrusion speed was 0.2 mm/s, edge tearing phenomena did not occur, but when the extrusion speed was 0.5 mm/s, it was observed that edge tearing phenomena occurred.

For reference, the above-described wrought aluminum alloy according to a comparative example in the present disclosure exhibited a yield strength of about 103 MPA, a tensile strength of about 288 MPa, and an elongation of about 10% when 0-tempered, and exhibited a yield strength of about 503 MPa, a tensile strength of about 572 MPa, and an elongation of about 11% when T6 heat treated.

FIG. 1 is a graph analyzing phase fractions during T6 heat treatment in a wrought aluminum alloy according to a comparative example in the present disclosure.

Referring to FIG. 1, phases are shown which are formed when the above-described wrought aluminum alloy according to a comparative example in the present disclosure is solution treated at 450° C. and then artificially aged at 125° C.

The phases making up the largest fraction are the T prime phrase and the Eta prime phase. These two phases are stable phases, and do not coarsen or transform into other phases when aging is carried out. Therefore, the two phases heavily contribute to the increase in yield strength following T6 heat treatment.

The GP zone phase, the S prime phase, and the theta prime phase also contribute to strength enhancement, but being metastable phases, coarsen or induce transformation into other phases when heat treated, and thus are major factors of deformation when T6 heat treatment is carried out.

The above-described wrought aluminum alloy according to a comparative example in the present disclosure includes significantly large fractions of such metastable phases, and thus, in the present disclosure, the fractions of such phases are fundamentally controlled by using additive elements.

A wrought aluminum alloy provided as an embodiment of the present disclosure is composed of 5.5 to 6.0 wt % of Zn; 2.0 to 2.5 wt % of Mg; 0.2 to 0.6 wt % of Cu; 0.1 to 0.2 wt % of Cr; at most 0.2 wt % (and more than 0 wt %) of Fe; at most 0.2 wt % (and more than 0 wt %) of Mn; at most 0.2 wt % (and more than 0 wt %) of Si; at most 0.1 wt % (and more than 0 wt %) of Ti; and at most 0.05 wt % (and more than 0 wt %) of Sr; with the remainder being unavoidable impurities and Al.

A wrought aluminum alloy according to the same exhibited a yield strength of about 243 MPa, a tensile strength of about 399 MPa, and an elongation of about 15.1% when F-tempered, and exhibited a yield strength of about 515 MPa, a tensile strength of about 565 MPa, and an elongation of about 10.7% when T6 heat treated.

Figure 2:
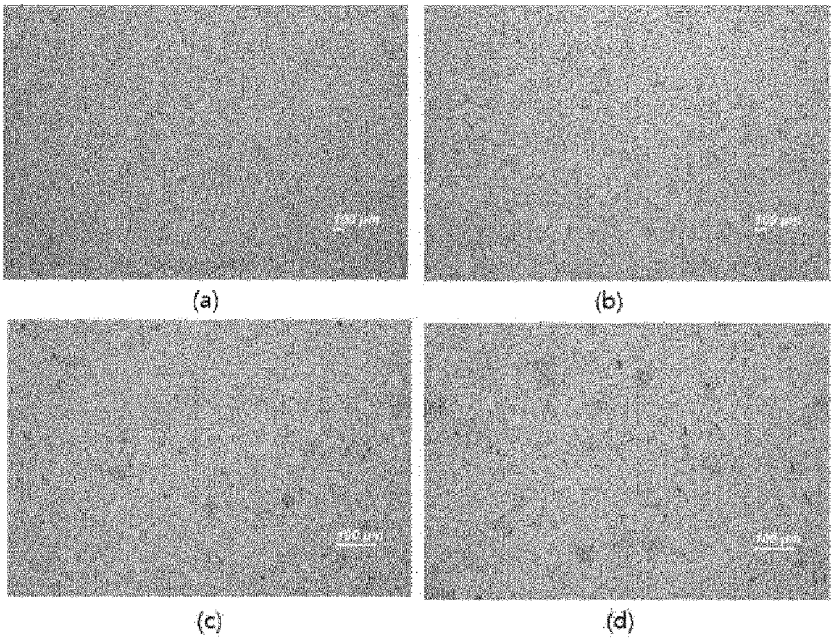
FIG. 2 is a photograph showing the microstructure of a wrought aluminum alloy according to an embodiment of the present disclosure.

FIG. 2 is a photograph showing the microstructure of a wrought aluminum alloy according to an embodiment of the present disclosure.

In FIG. 2, (a) shows the microstructure of an extrusion product of the above-described wrought aluminum alloy according to an embodiment of the present disclosure at low magnification (×50) following F-tempering, (b) shows the microstructure of an extrusion product of the above-described wrought aluminum alloy according to an embodiment of the present disclosure at high magnification (×200) following F-tempering, (c) shows the microstructure of an extrusion product of the above-described wrought aluminum alloy according to an embodiment of the present disclosure at low magnification (×50) following T6 heat treatment, and (d) shows the microstructure of an extrusion product of the above-described wrought aluminum alloy according to an embodiment of the present disclosure at high magnification (×200) following T6 heat treatment.

It was observed that in the above-described wrought aluminum alloy according to an embodiment of the present disclosure, edge tearing phenomena was not exhibited even when the extrusion speed was 1.0 mm/s. Moreover, it was observed that deformation does not occur even when press water quenching (PWQ) is performed.

Hereinafter, alloying elements controlling extrudability in a wrought aluminum alloy according to an embodiment of the present disclosure are examined, and the reasons for specifying the composition ranges thereof are explained along with experimental examples, in order to facilitate understanding of the present disclosure. However, the experimental examples below are merely for facilitating understanding of the present disclosure, and the present disclosure is not limited to the experimental examples described below.

The present inventors discovered that extrudability decreases suddenly when the shear modulus of a wrought aluminum alloy exceeds 19 GPa. This prior premise was derived by using, as comparative data, the fact that, for example, A6061 alloy is calculated to have a shear modulus of about 18.8 GPa under conditions of an extrusion speed of 1.2 mm/s and an extrusion temperature of 445° C., and A7075 alloy is calculated to have a shear modulus of about 19.16 GPa under conditions of an extrusion speed of 0.2 mm/s and an extrusion temperature of 450° C.

Alloying Element Controlled to Enhance Extrudability: Zinc (Zn)

Figure 3:
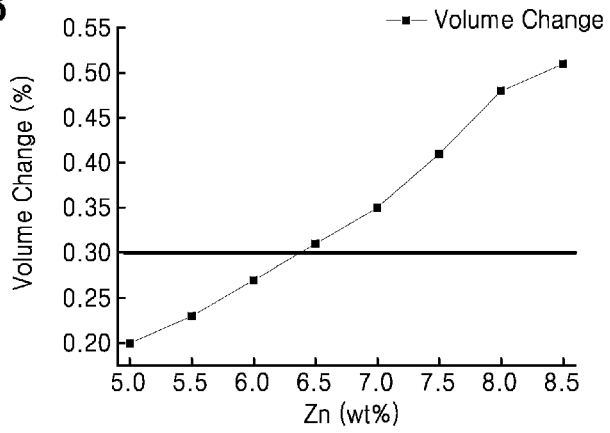
FIG. 3 is a graph analyzing the change in volume change ratio along the solidus according to Zn content in a wrought aluminum alloy according to an experimental example in the present disclosure.
Figure 4:
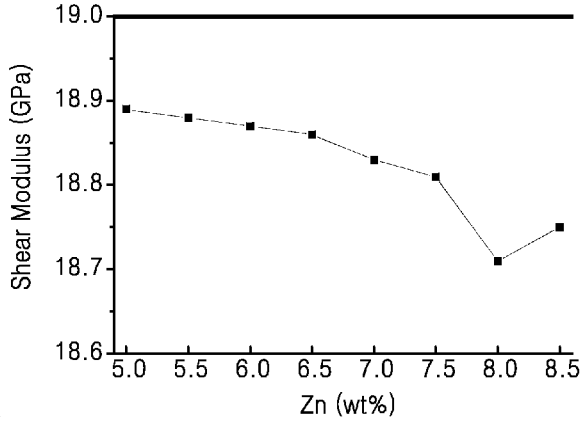
FIG. 4 is a graph analyzing the change in shear modulus change ratio along the solidus according to Zn content in a wrought aluminum alloy according to an experimental example in the present disclosure.
Figure 7:
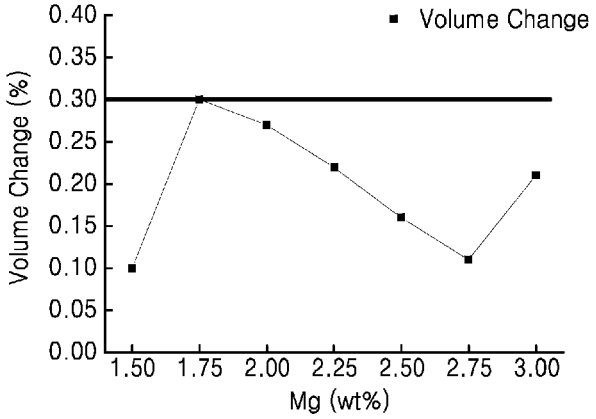
FIG. 7 is a graph analyzing the change in volume change ratio along the solidus according to Mg content in a wrought aluminum alloy according to an experimental example in the present disclosure.
Figure 8:
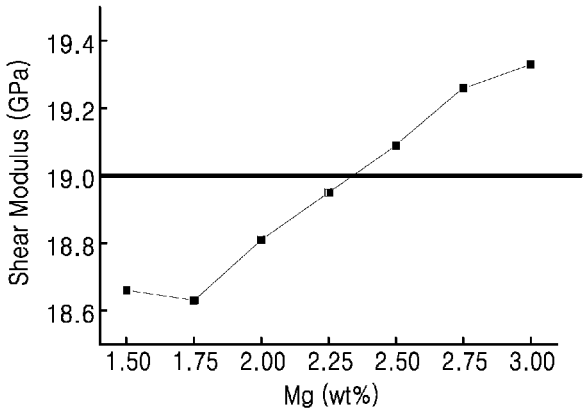
FIG. 8 is a graph analyzing the change in shear modulus change ratio according to Mg content in a wrought aluminum alloy according to an experimental example in the present disclosure.

FIG. 3 is a graph analyzing the change in volume change ratio along the solidus according to Zn content in a wrought aluminum alloy according to an experimental example in the present disclosure, FIG. 4 is a graph analyzing the change in shear modulus change ratio along the solidus according to Zn content in a wrought aluminum alloy according to an experimental example in the present disclosure, FIG. 7 is a graph of experimentally measured yield strength according to Zn content of a wrought aluminum alloy according to an experimental example in the present disclosure, and FIG. 8 is a graph of experimentally measured change in extrusion speed according to Zn content in a wrought aluminum alloy according to an experimental example in the present disclosure.

A wrought aluminum alloy according to the experimental example is an alloy in which the composition of Zn is arbitrarily varied, and is composed of 2.0 to 2.5 wt % of Mg; 0.2 to 0.6 wt % of Cu; 0.1 to 0.2 wt % of Cr; at most 0.2 wt % (and more than 0 wt %) of Fe; at most 0.2 wt % (and more than 0 wt %) of Mn; at most 0.2 wt % (and more than 0 wt %) of Si; at most 0.1 wt % (and more than 0 wt %) of Ti; and at most 0.2 wt % (and more than 0 wt %) of Sr; with the remainder being unavoidable impurities and Al.

Figure 5:
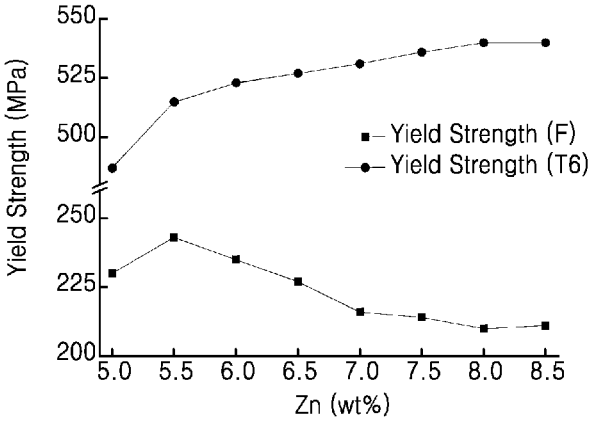
FIG. 5 is a graph of experimentally measured yield strength according to Zn content of a wrought aluminum alloy according to an experimental example in the present disclosure.
Figure 6:
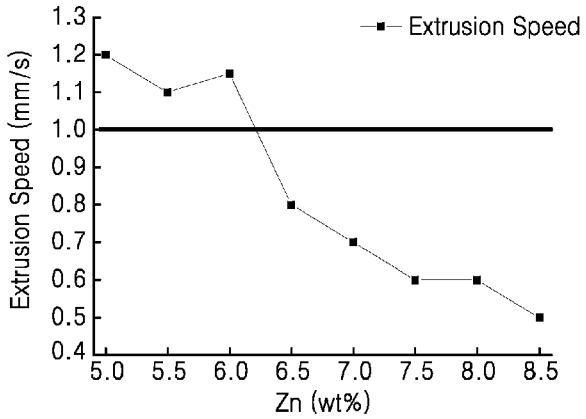
FIG. 6 is a graph of experimentally measured change in extrusion speed according to Zn content in a wrought aluminum alloy according to an experimental example in the present disclosure.

Referring to FIG. 3, in view of preventing cracks from occurring during the process of continuous casting into billets, it is desirable to specify a Zn content of 6.5 wt % or lower. Referring to FIG. 4, in view of shear modulus, it is analyzed that in the case of Zn, a large effect is absent up to 5-8.5 wt %. Referring to FIG. 5, it is analyzed that at a Zn content of 5.5 wt % or higher, yield strength decreases with Zn content prior to heat treatment, and increases with Zn content following heat treatment. Referring to FIG. 6, it is analyzed that in view of extrusion speed, the best properties are exhibited at a Zn content of 5 to 6 wt %.

Table 1 displays the change in the values of properties according to Zn content, of wrought aluminum alloys according to the experimental example of the present disclosure.

TABLE 1

| Zn content | Shear Modulus (GPa) | Volume change along solidus (%) | Yield strength F (MPa) | Yield strength T6 (MPa) | Extrusion speed (mm/s) |
|---|---|---|---|---|---|
| 5 | 18.89 | 0.2 | 230 | 487 | 1.2 |
| 5.5 | 18.88 | 0.23 | 243 | 515 | 1.1 |
| 6 | 18.87 | 0.27 | 235 | 523 | 1.15 |
| 6.5 | 18.86 | 0.31 | 227 | 527 | 0.8 |
| 7 | 18.83 | 0.35 | 216 | 531 | 0.7 |
| 7.5 | 18.81 | 0.41 | 214 | 536 | 0.6 |
| 8 | 18.71 | 0.48 | 210 | 540 | 0.6 |
| 8.5 | 18.75 | 0.51 | 211 | 540 | 0.5 |

Referring to Table 1, although it is advantageous to increase the Zn composition to about 8 wt % in view of shear strength, since it is necessary for the Zn content to not exceed 0.3 wt % in view of the volume change which occurs near the solidus during continuous casting of billets, it is necessary to specify a Zn content of 6 wt % or lower. Moreover, in view of yield strength, the billet in the F state was evaluated to have the highest yield strength at a Zn content of 5.5 wt %, and even though the strength following T6 heat treatment increases with Zn content, it is necessary in view of extrusion speed for Zn content to not exceed 6 wt %. Therefore, when volume change, shear modulus, yield strength, and extrusion speed are all taken into consideration, it is determined that the Zn content in the wrought aluminum alloy according to an embodiment of the present disclosure is desirably specified to be 5.5 to 6.0 wt %.

Alloying Element Controlled to Enhance Extrudability: Magnesium (Mg)

Figure 9:
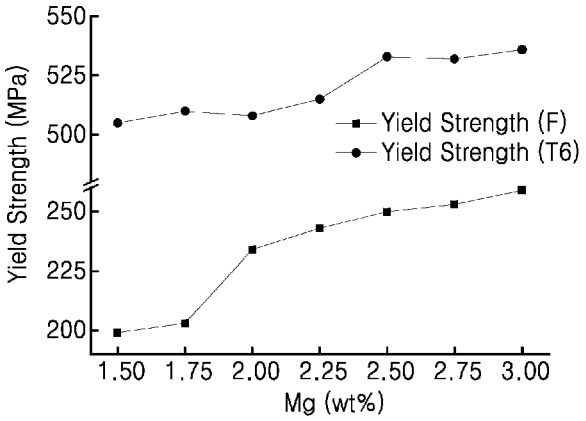
FIG. 9 is a graph of experimentally measured yield strength according to Mg content of a wrought aluminum alloy according to an experimental example in the present disclosure.
Figure 10:
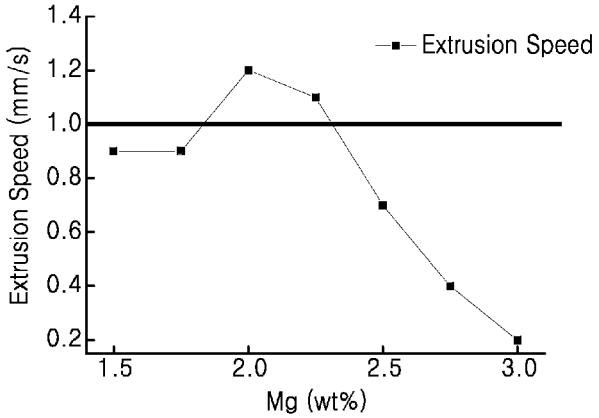
FIG. 10 is a graph of experimentally measured change in extrusion speed according to Mg content in a wrought aluminum alloy according to an experimental example in the present disclosure.

FIG. 7 is a graph analyzing the change in volume change ratio along the solidus according to Mg content in a wrought aluminum alloy according to an experimental example in the present disclosure, FIG. 8 is a graph analyzing the change in shear modulus change ratio according to Mg content in a wrought aluminum alloy according to an experimental example in the present disclosure, FIG. 9 is a graph of experimentally measured yield strength according to Mg content of a wrought aluminum alloy according to an experimental example in the present disclosure, and FIG. 10 is a graph of experimentally measured change in extrusion speed according to Mg content in a wrought aluminum alloy according to an experimental example in the present disclosure.

A wrought aluminum alloy according to the experimental example is an alloy in which the composition of Mg is arbitrarily varied, and is composed of 5.5 to 6.0 wt % of Zn; 0.2 to 0.6 wt % of Cu; 0.1 to 0.2 wt % of Cr; at most 0.2 wt % (and more than 0 wt %) of Fe; at most 0.2 wt % (and more than 0 wt %) of Mn; at most 0.2 wt % (and more than 0 wt %) of Si; at most 0.1 wt % (and more than 0 wt %) of Ti; and at most 0.05 wt % (and more than 0 wt %) of Sr; with the remainder being unavoidable impurities and Al.

Referring to FIG. 7, in view of preventing cracks from occurring during the process of continuous casting into billets, it is desirable to specify a Mg content of 2 wt % or higher. Referring to FIG. 8, in view of shear modulus, it is desirable to specify a Mg content of 2.25 wt % or lower. Referring to FIG. 9, although the yield strength following heat treatment continuously increases with Mg content, such that it is advantageous to add up to 3 wt % of Mg, it is desirable to limit the Mg content to at most 2.8 wt % in consideration of other properties. Referring to FIG. 10, it is analyzed that it is desirable to specify a Mg content of 2 to 2.5 wt % in view of extrusion speed. In consideration of volume change, yield strength, extrusion speed, minute changes in the content of other elements, and on-site productivity, a Mg content of 2 to 2.75 wt % may be specified.

Table 2 displays the change in the values of properties according to Mg content, of wrought aluminum alloys according to the experimental example of the present disclosure.

TABLE 2

| Mg content | Shear Modulus (GPa) | Volume change along solidus (%) | Yield strength F (MPa) | Yield strength T6 (MPa) | Extrusion speed (mm/s) |
|---|---|---|---|---|---|
| 1.5 | 18.66 | 0.1 | 199 | 505 | 0.9 |
| 1.75 | 18.63 | 0.30 | 203 | 510 | 0.9 |
| 2 | 18.81 | 0.27 | 234 | 508 | 1.2 |
| 2.25 | 18.95 | 0.22 | 243 | 515 | 1.1 |
| 2.5 | 19.09 | 0.16 | 250 | 533 | 0.7 |
| 2.75 | 19.26 | 0.11 | 253 | 532 | 0.4 |
| 3 | 19.33 | 0.21 | 259 | 536 | 0.2 |

Referring to Table 2, although the optimal Mg composition is advantageously 2.25 wt % or lower in view of shear modulus, desirably 1.5 to 3 wt % in view of volume change, and a higher Mg content is more advantageous in view of yield strength, it is necessary to exclude values of 19 GPa or higher in consideration of extrudability. Thus, when all of volume change, shear modulus, yield strength, and extrusion speed are considered, it is determined that the Mg content in the wrought aluminum alloy according to an embodiment of the present disclosure is desirably 2.0 to 2.5 wt %, and more desirably, 2.0 to 2.25 wt %.

T6 Heat Treatment Deformation Control and Yield Strength Factor: Copper (Cu)

Figure 11:
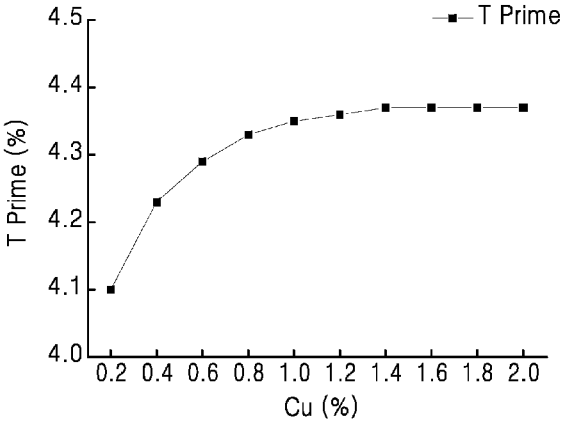
FIG. 11 is a graph analyzing the change in T prime phase ratio according to Cu content in a wrought aluminum alloy according to an experimental example in the present disclosure.
Figure 12:
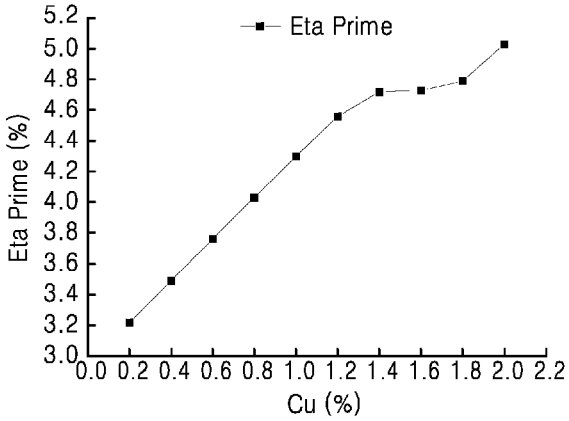
FIG. 12 is a graph analyzing the change in Eta prime phase ratio according to Cu content in a wrought aluminum alloy according to an experimental example in the present disclosure.
Figure 13:
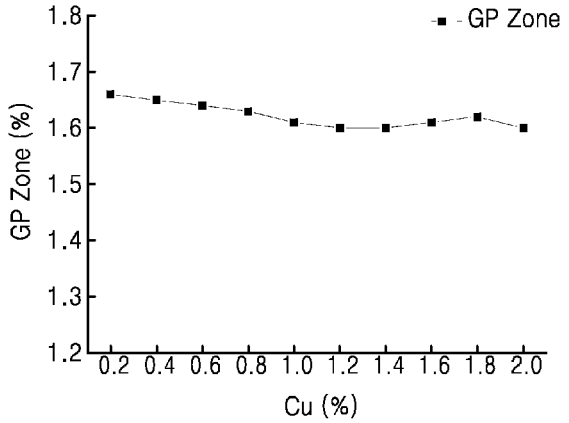
FIG. 13 is a graph analyzing the change in GP zone phase ratio according to Cu content in a wrought aluminum alloy according to an experimental example in the present disclosure.
Figure 14:
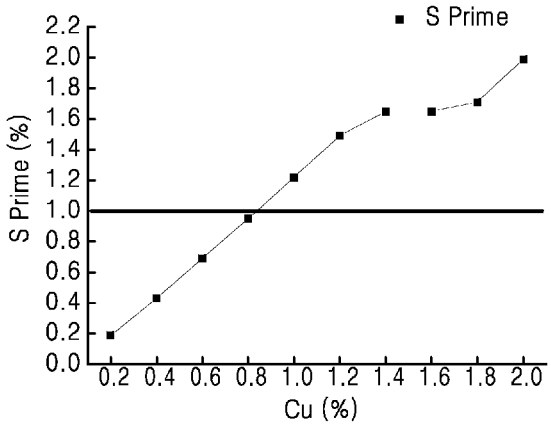
FIG. 14 is a graph analyzing the change in S prime phase ratio according to Cu content in a wrought aluminum alloy according to an experimental example in the present disclosure.
Figure 15:
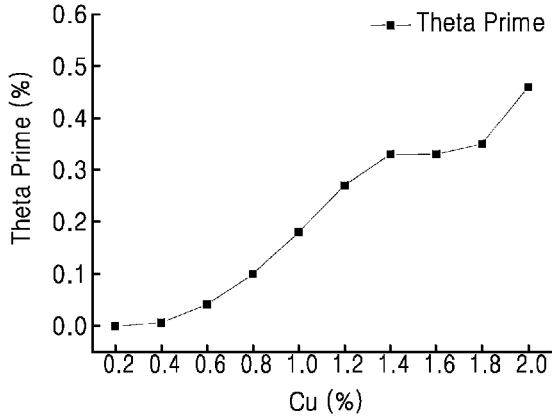
FIG. 15 is a graph analyzing the change in Theta prime phase ratio according to Cu content in a wrought aluminum alloy according to an experimental example in the present disclosure.
Figure 16:
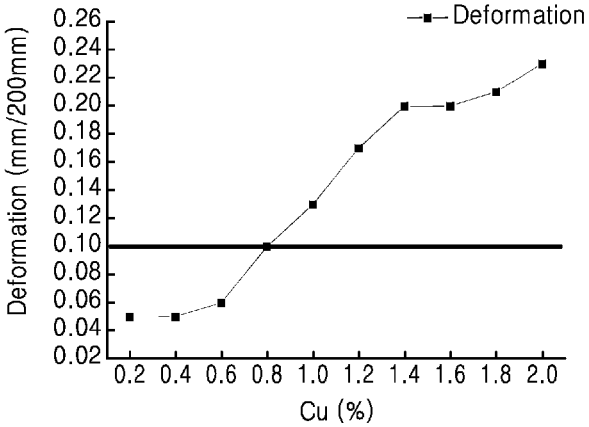
FIG. 16 is a graph of experimentally measured deformation according to Cu content in a wrought aluminum alloy according to an experimental example in the present disclosure.
Figure 17:
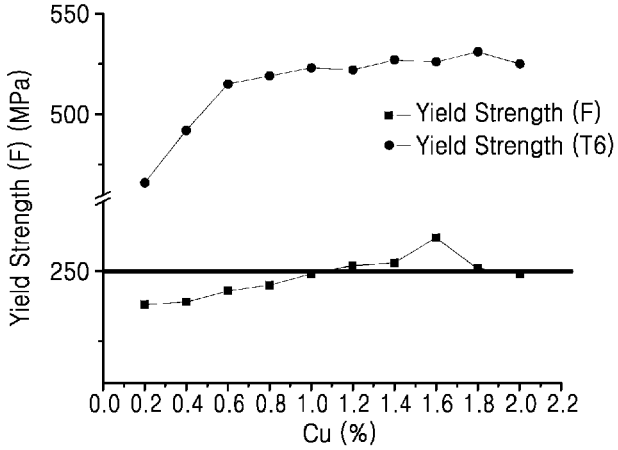
FIG. 17 is a graph of experimentally measured yield strength according to Cu content of a wrought aluminum alloy according to an experimental example in the present disclosure.

FIG. 11 is a graph analyzing the change in T prime phase ratio according to Cu content in a wrought aluminum alloy according to an experimental example in the present disclosure, FIG. 12 is a graph analyzing the change in Eta prime phase ratio according to Cu content in a wrought aluminum alloy according to an experimental example in the present disclosure, FIG. 13 is a graph analyzing the change in GP zone phase ratio according to Cu content in a wrought aluminum alloy according to an experimental example in the present disclosure, FIG. 14 is a graph analyzing the change in S prime phase ratio according to Cu content in a wrought aluminum alloy according to an experimental example in the present disclosure, FIG. 15 is a graph analyzing the change in Theta prime phase ratio according to Cu content in a wrought aluminum alloy according to an experimental example in the present disclosure, FIG. 16 is a graph of experimentally measured deformation according to Cu content in a wrought aluminum alloy according to an experimental example in the present disclosure, and FIG. 17 is a graph of experimentally measured yield strength according to Cu content of a wrought aluminum alloy according to an experimental example in the present disclosure.

A wrought aluminum alloy according to the experimental example is an alloy in which the composition of Cu is arbitrarily varied, and is composed of 5.5 to 6.0 wt % of Zn; 2.0 to 2.5 wt % of Mg; 0.1 to 0.2 wt % of Cr; at most 0.2 wt % (and more than 0 wt %) of Fe; at most 0.2 wt % (and more than 0 wt %) of Mn; at most 0.2 wt % (and more than 0 wt %) of Si; at most 0.1 wt % (and more than 0 wt %) of Ti; and at most 0.05 wt % (and more than 0 wt %) of Sr; with the remainder being Al.

Referring to FIG. 11, the T prime phase according to Cu content converges starting from 0.8 wt % of Cu, and thus it is desirable to limit the Cu content to at most 0.8 wt %. Referring to FIG. 12, the Eta prime phase according to Cu content is analyzed to continuously increase, and thus it is analyzed that increasing the Cu content is desirable. Referring to FIG. 13, the GP zone phase according to Cu content is determined to be maintained stable between 1.6 to 1.7 wt %, and thus Cu content is analyzed to not have a large effect. Referring to FIG. 14, the S prime phase fraction increases in proportion to Cu content, and thus it is desirable to limit the Cu content to 0.8 wt % or lower, where the S prime phase fraction is 1 wt % or lower. Referring to FIG. 15, although the Theta prime phase also increases with Cu content, since the fraction is determined to be extremely low when the Cu content is at or below 1.4 wt %, it is desirable in view of the Theta prime phase to limit Cu to 1.4 wt % or lower. Referring to FIG. 16, in view of deformation, it is determined that limiting the Cu content to below 0.8 wt % is desirable.

Furthermore, referring to FIG. 17, yield strength following heat treatment is characterized by being proportional to Cu content but converging starting from a Cu content of 0.6 wt %. Since, in view of extrudability, an F state yield strength prior to heat treatment of 250 MPa or lower is appropriate, it is analyzed that limiting the Cu content to 0.6 wt % or lower in view of yield strength is desirable.

Therefore, in view of the T prime phase, Eta prime phase, GP zone phase, S prime phase, Theta prime phase, deformation, and yield strength, it is determined that it is most desirable to specify a Cu content of 0.4 to 0.8 wt %.

Table 3 displays the change in phase fractions and the like according to Cu content, of wrought aluminum alloys according to the experimental example of the present disclosure.

TABLE 3

| Cu content | T' % | η' % | GP % | S' % | θ' % | Deformation mm/200 mm | Yield strength F (MPa) | Yield strength T6 (MPa) |
|---|---|---|---|---|---|---|---|---|
| 0.2 | 4.1 | 3.22 | 1.66 | 0.19 | 0 | 0.05 | 238 | 466 |
| 0.4 | 4.23 | 3.49 | 1.65 | 0.43 | 0.00614 | 0.05 | 239 | 492 |
| 0.6 | 4.29 | 3.76 | 1.64 | 0.69 | 0.0416 | 0.06 | 243 | 515 |
| 0.8 | 4.33 | 4.03 | 1.63 | 0.95 | 0.1 | 0.10 | 245 | 519 |
| 1.0 | 4.35 | 4.3 | 1.61 | 1.22 | 0.18 | 0.13 | 249 | 523 |
| 1.2 | 4.36 | 4.56 | 1.6 | 1.49 | 0.27 | 0.17 | 252 | 522 |
| 1.4 | 4.37 | 4.72 | 1.6 | 1.65 | 0.33 | 0.20 | 253 | 527 |
| 1.6 | 4.37 | 4.73 | 1.61 | 1.65 | 0.33 | 0.20 | 262 | 526 |
| 1.8 | 4.37 | 4.79 | 1.62 | 1.71 | 0.35 | 0.21 | 251 | 531 |
| 2.0 | 4.37 | 5.03 | 1.6 | 1.99 | 0.46 | 0.23 | 249 | 525 |

Referring to and thereby summarizing Table 3, it is analyzed that as the content increases, the Cu composition contributes to strength enhancement when solution heat treatment is performed, and increases the phase fractions of the stable phases $Al_2Mg_3Zn_3$ T' and MgZn2 η'. In Al—Cu alloys, which are 2000 series alloys, Cu content has a large effect on GP zone fraction, but in the case of 7000 series alloys, since the GP zone is an a phase in which the solid elements Cu, Mg, and Zn are formed simultaneously, and the artificial aging temperature is high, the effect of Cu content on the GP zone was not large. Moreover, although Cu contributes to strength enhancement when T6 heat treatment is carried out, and thus, due to lattice modification, did not have a large effect on the GP zone among GP, S' ($Al_2CuMg$), and θ' ($Al_2Cu$), which are phases generating deformation and residual stress during heat treatment, it was observed that the S' and θ' phases increased rapidly at Cu contents of 0.8 wt % or higher. Thus, in view of the phase analysis results, dimensional changes which occur when heat treatment is preformed, and strength, it is determined that it is most desirable to specify a Cu content of 0.2 to 0.6 wt %.

T6 Heat Treatment Deformation Control and Yield Strength Factor: Magnesium (Mg)

Figure 18:
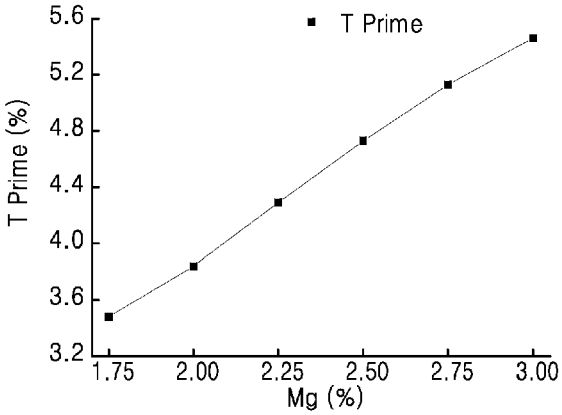
FIG. 18 is a graph analyzing the change in T prime phase ratio according to Mg content in a wrought aluminum alloy according to an experimental example in the present disclosure.
Figure 19:
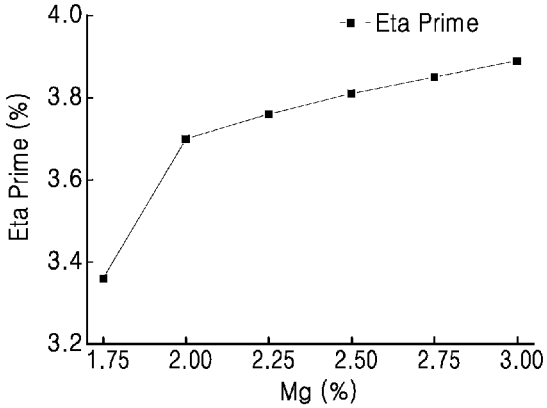
FIG. 19 is a graph analyzing the change in Eta prime phase ratio according to Mg content in a wrought aluminum alloy according to an experimental example in the present disclosure.
Figure 20:
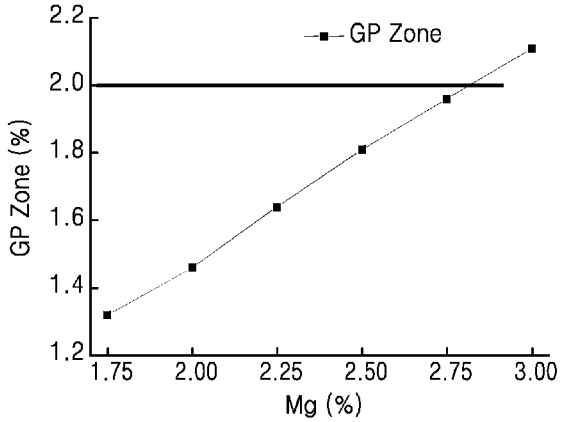
FIG. 20 is a graph analyzing the change in GP zone phase ratio according to Mg content in a wrought aluminum alloy according to an experimental example in the present disclosure.
Figure 21:
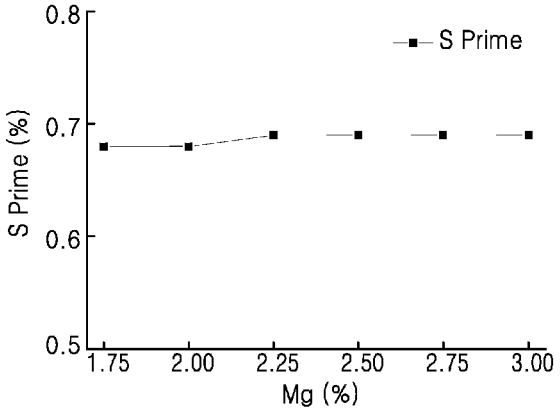
FIG. 21 is a graph analyzing the change in S prime phase ratio according to Mg content in a wrought aluminum alloy according to an experimental example in the present disclosure.
Figure 22:
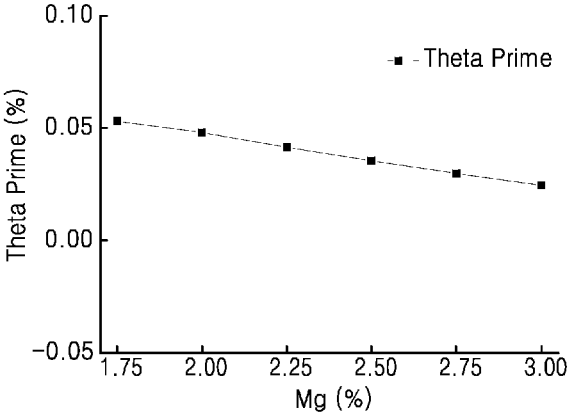
FIG. 22 is a graph analyzing the change in Theta prime phase ratio according to Mg content in a wrought aluminum alloy according to an experimental example in the present disclosure.
Figure 23:
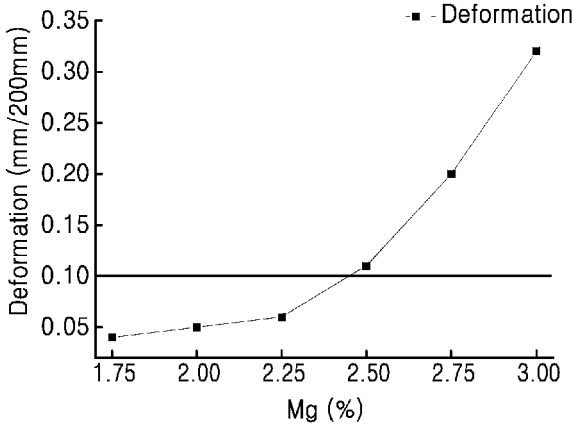
FIG. 23 is a graph of experimentally measured deformation according to Mg content in a wrought aluminum alloy according to an experimental example in the present disclosure.
Figure 24:
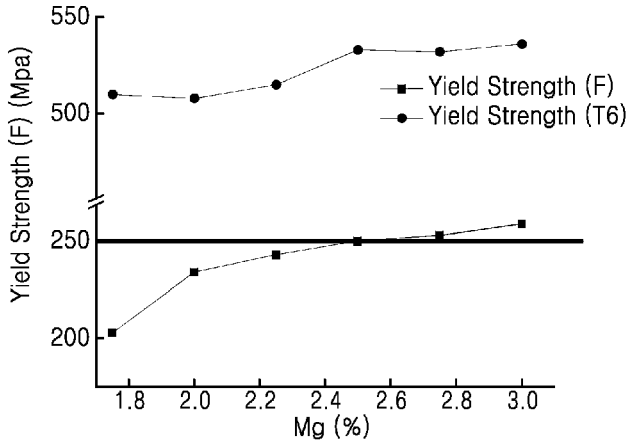
FIG. 24 is a graph of experimentally measured yield strength according to Mg content of a wrought aluminum alloy according to an experimental example in the present disclosure.

FIG. 18 is a graph analyzing the change in T prime phase ratio according to Mg content in a wrought aluminum alloy according to an experimental example in the present disclosure, FIG. 19 is a graph analyzing the change in Eta prime phase ratio according to Mg content in a wrought aluminum alloy according to an experimental example in the present disclosure, FIG. 20 is a graph analyzing the change in GP zone phase ratio according to Mg content in a wrought aluminum alloy according to an experimental example in the present disclosure, FIG. 21 is a graph analyzing the change in S prime phase ratio according to Mg content in a wrought aluminum alloy according to an experimental example in the present disclosure, FIG. 22 is a graph analyzing the change in Theta prime phase ratio according to Mg content in a wrought aluminum alloy according to an experimental example in the present disclosure, FIG. 23 is a graph of experimentally measured deformation according to Mg content in a wrought aluminum alloy according to an experimental example in the present disclosure, and FIG. 24 is a graph of experimentally measured yield strength according to Mg content of a wrought aluminum alloy according to an experimental example in the present disclosure.

A wrought aluminum alloy according to the experimental example is an alloy in which the composition of Mg is arbitrarily varied, and is composed of 5.5 to 6.0 wt % of Zn; 0.2 to 0.6 wt % of Cu; 0.1 to 0.2 wt % of Cr; at most 0.2 wt % (and more than 0 wt %) of Fe; at most 0.2 wt % (and more than 0 wt %) of Mn; at most 0.2 wt % (and more than 0 wt %) of Si; at most 0.1 wt % (and more than 0 wt %) of Ti; and at most 0.05 wt % (and more than 0 wt %) of Sr; with the remainder being Al.

Referring to FIG. 18, Mg content was evaluated for appropriateness in the range of 1.75 to 3 wt %, near the optimal composition of 2 to 2.25 wt % of the extrudability evaluation factor mentioned above. Since the T prime phase continuously increases with Mg content, it is determined that it is possible to add up to 3 wt % of Mg in view of T prime. Referring to FIGS. 19, 2 to 3 wt % of Mg is determined to be appropriate in view of Eta prime. Referring to FIG. 20, it is desirable to specify an Mg content of 2.75 wt % or lower in order to prevent the GP zone phase from exceeding 2 wt %. Referring to FIG. 21, the S prime phase maintains a fraction of 0.6 to 0.7 wt % independent of Mg content, and thus it is determined that Mg content does not have a large effect thereon.

Referring to FIG. 22, the Theta prime phase is analyzed to decrease very slightly with Mg content, and thus it is determined that Mg content does not have a large effect thereon. Referring to FIG. 23, it is desirable to limit the Mg content to below 2.5 wt % in view of deformation. Referring to FIG. 24, although yield strength following heat treatment is proportional to Mg content, since F state yield strength prior to heat treatment is appropriately 250 MPa or lower in view of extrudability, it is determined that it is desirable for Mg content to be below 2.5 wt % in view of yield strength.

Therefore, in view of the T prime phase, Eta prime phase, GP zone phase, S prime phase, Theta prime phase, deformation, and yield strength, it is determined that it is most desirable to specify an Mg content of 2 to 2.5 wt %.

Table 4 displays the change in phase fractions and the like according to Mg content, of wrought aluminum alloys according to the experimental example of the present disclosure.

TABLE 4

| Mg content | T' % | η' % | GP % | S' % | θ' % | Deformation (mm/200 mm) | Yield strength F (MPa) | Yield strength T6 (MPa) |
|---|---|---|---|---|---|---|---|---|
| 1.75 | 3.48 | 3.36 | 1.32 | 0.68 | 0.0532 | 0.04 | 203 | 510 |
| 2 | 3.84 | 3.70 | 1.46 | 0.68 | 0.0481 | 0.05 | 234 | 508 |
| 2.25 | 4.29 | 3.76 | 1.64 | 0.69 | 0.0416 | 0.06 | 243 | 515 |
| 2.5 | 4.73 | 3.81 | 1.81 | 0.69 | 0.0355 | 0.11 | 250 | 533 |
| 2.75 | 5.13 | 3.85 | 1.96 | 0.69 | 0.0298 | 0.20 | 253 | 532 |
| 3 | 5.46 | 3.89 | 2.11 | 0.69 | 0.0246 | 0.32 | 259 | 536 |

Referring to and thereby summarizing Table 4, as in the case of Cu, when Mg content increases, an increase in the T' and η' phases enhances strength. However, unlike the case of Cu, although Mg content does not have an effect on the S' and θ' phases, since the GP zone begins to exceed the optimal GP zone fraction of around 1.7% at an Mg content of 2.4 wt % and the deformation rate generated when heat treatment is carried out increases with Mg content, it may be desirable to specify an Mg content of about 2 to 2.3 wt %.

T6 Heat Treatment Deformation Control and Yield Strength Factor: Zinc (Zn)

Figure 25:
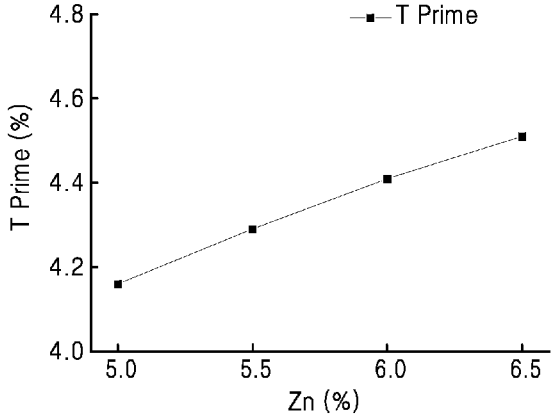
FIG. 25 is a graph analyzing the change in T prime phase ratio according to Zn content in a wrought aluminum alloy according to an experimental example in the present disclosure.
Figure 26:
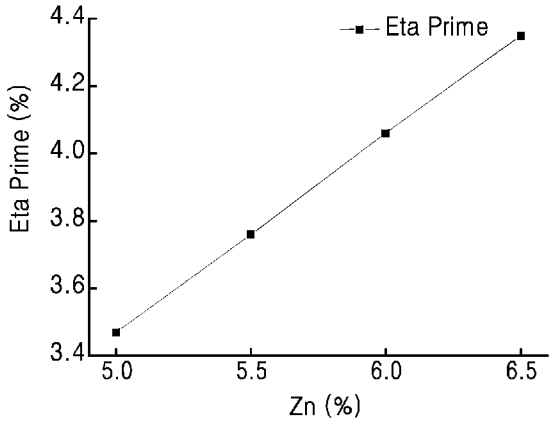
FIG. 26 is a graph analyzing the change in Eta prime phase ratio according to Zn content in a wrought aluminum alloy according to an experimental example in the present disclosure.
Figure 27:
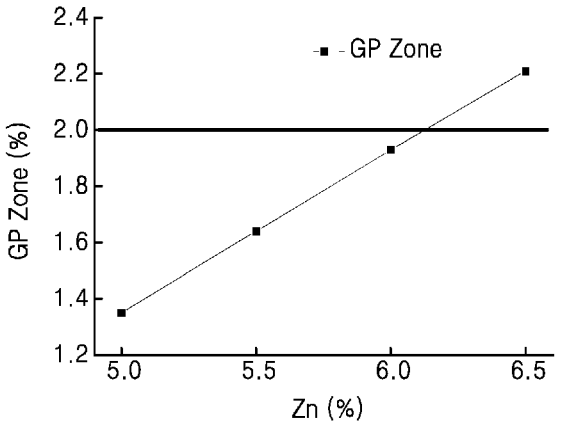
FIG. 27 is a graph analyzing the change in GP zone phase ratio according to Zn content in a wrought aluminum alloy according to an experimental example in the present disclosure.
Figure 28:
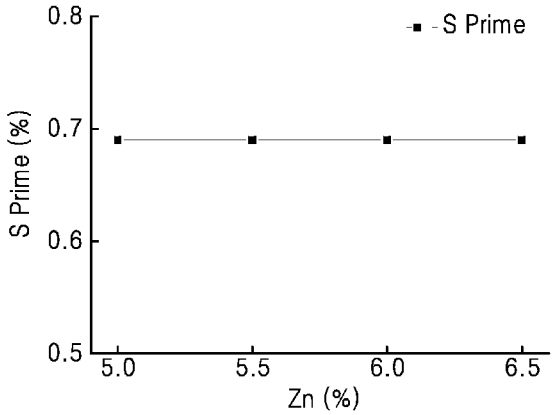
FIG. 28 is a graph analyzing the change in S prime phase ratio according to Zn content in a wrought aluminum alloy according to an experimental example in the present disclosure.
Figure 29:
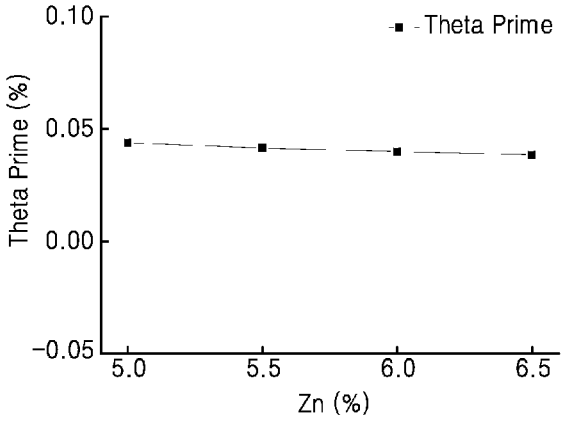
FIG. 29 is a graph analyzing the change in Theta prime phase ratio according to Zn content in a wrought aluminum alloy according to an experimental example in the present disclosure.
Figure 30:
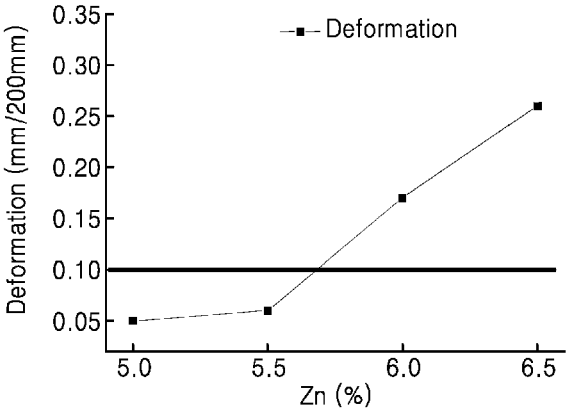
FIG. 30 is a graph of experimentally measured deformation according to Zn content in a wrought aluminum alloy according to an experimental example in the present disclosure.
Figure 31:
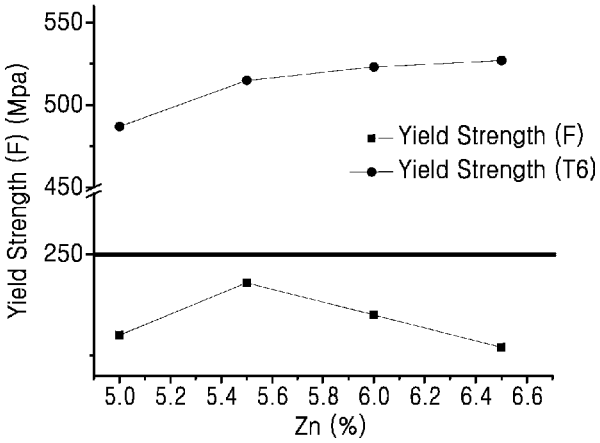
FIG. 31 is a graph of experimentally measured yield strength according to Zn content of a wrought aluminum alloy according to an experimental example in the present disclosure.

FIG. 25 is a graph analyzing the change in T prime phase ratio according to Zn content in a wrought aluminum alloy according to an experimental example in the present disclosure, FIG. 26 is a graph analyzing the change in Eta prime phase ratio according to Zn content in a wrought aluminum alloy according to an experimental example in the present disclosure, FIG. 27 is a graph analyzing the change in GP zone phase ratio according to Zn content in a wrought aluminum alloy according to an experimental example in the present disclosure, FIG. 28 is a graph analyzing the change in S prime phase ratio according to Zn content in a wrought aluminum alloy according to an experimental example in the present disclosure, FIG. 29 is a graph analyzing the change in Theta prime phase ratio according to Zn content in a wrought aluminum alloy according to an experimental example in the present disclosure, FIG. 30 is a graph of experimentally measured deformation according to Zn content in a wrought aluminum alloy according to an experimental example in the present disclosure, and FIG. 31 is a graph of experimentally measured yield strength according to Zn content of a wrought aluminum alloy according to an experimental example in the present disclosure.

A wrought aluminum alloy according to the experimental example is an alloy in which the composition of Zn is arbitrarily varied, and is composed of 2.0 to 2.5 wt % of Mg; 0.2 to 0.6 wt % of Cu; 0.1 to 0.2 wt % of Cr; at most 0.2 wt % (and more than 0 wt %) of Fe; at most 0.2 wt % (and more than 0 wt %) of Mn; at most 0.2 wt % (and more than 0 wt %) of Si; at most 0.1 wt % (and more than 0 wt %) of Ti; and at most 0.05 wt % (and more than 0 wt %) of Sr; with the remainder being Al.

Referring to FIG. 25, Zn content was evaluated for appropriateness in the range of 5-6.5 wt % by extending by 0.5 wt % in both directions, the range of 5.5-6.5 wt % specified above in view of extrusion speed control. Since the T prime phase increases continuously with Zn content, it is determined that it is possible to add up to 6.5 wt % of Zn in view of T prime. Referring to FIG. 26, it is determined that it is possible to add up to 6.5 wt % of Zn in view of the Eta prime phase. Referring to FIG. 27, it is desirable to limit Zn content to 6 wt % or lower in order to ensure that GP zone does not exceed 2%. Referring to FIG. 28, it is determined that the S prime phase maintains a fraction of 0.6-0.7% independent of Zn content, and thus it is determined that Zn content does not have a large effect thereon. Referring to FIG. 29, the Theta prime phase is analyzed to decrease very slightly with Zn content, and thus is determined that Zn content does not have a large effect thereon. Referring to FIG. 30, it is desirable to specify a Zn content of 5.5-6.5 wt % in view of deformation. Referring to FIG. 31, although it was analyzed that yield strength following heat treatment is proportional to Zn content, and F state yield strength prior to heat treatment, being 250 MPa or lower and thus appropriate over the entire range, does not have a large effect, it is determined that in view of the T prime phase, Eta prime phase, GP zone phase, S prime phase, Theta prime phase, deformation, and yield strength, it is most desirable to specify a Zn content of 5.5-6 wt %.

Table 5 displays the change in phase fractions and the like according to Zn content, of wrought aluminum alloys according to the experimental example of the present disclosure.

TABLE 5

| Zn content | T' % | η' % | GP % | S' % | θ' % | Deformation (mm/200 mm) | Yield strength F (MPa) | Yield strength T6 (MPa) |
|---|---|---|---|---|---|---|---|---|
| 5 | 4.16 | 3.47 | 1.35 | 0.69 | 0.0439 | 0.05 | 230 | 487 |
| 5.5 | 4.29 | 3.76 | 1.64 | 0.69 | 0.0416 | 0.06 | 243 | 515 |
| 6 | 4.41 | 4.06 | 1.93 | 0.69 | 0.04 | 0.17 | 235 | 523 |
| 6.5 | 4.51 | 4.35 | 2.21 | 0.69 | 0.0384 | 0.26 | 227 | 527 |

Referring to and thereby summarizing Table 5, as in the case of Mg and Cu, when Zn content increases, an increase in the T' and η' phases enhances strength. As in the case of Mg, and unlike the case of Cu, although Zn content does not have an effect on the S' and θ' phases, since the GP zone begins to exceed the optimal GP zone fraction of around 1.7% at a Zn content of 6% and the deformation rate generated when heat treatment is carried out increases with Zn content, it is analyzed that a Zn content of at least 5% and below 6% is advantageous in view of heat treatment deformation rate control.

Figure 32:
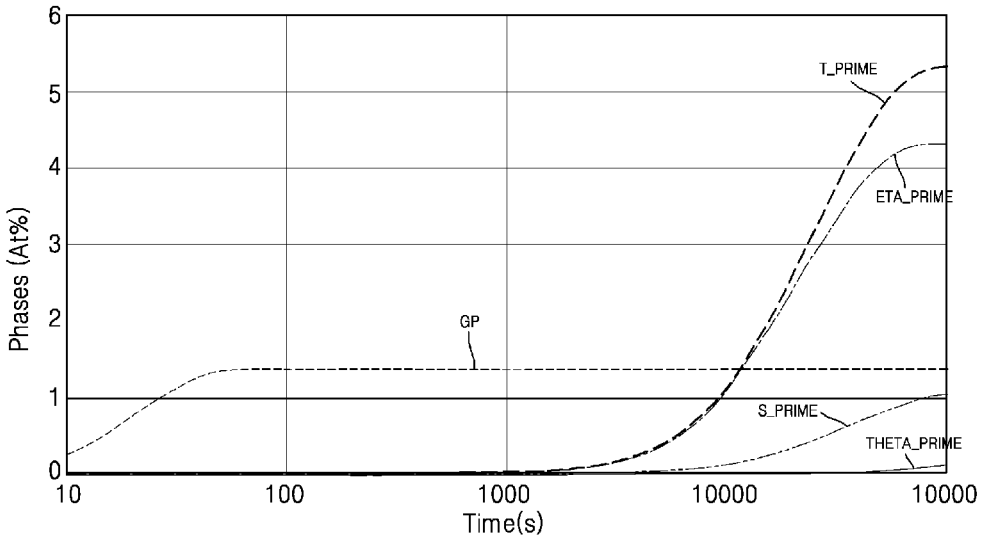
FIG. 32 is a graph analyzing phase fractions during T6 heat treatment in a wrought aluminum alloy according to an embodiment of the present disclosure.

FIG. 32 is a graph analyzing phase fractions during T6 heat treatment in a wrought aluminum alloy according to an embodiment of the present disclosure.

Referring to FIG. 32, displayed are phases which form when artificial aging is carried out at 125° C. after solution treating the above-described wrought aluminum alloy according to an embodiment of the present disclosure at 450° C. The phases making up the largest fraction are the T prime phrase and the Eta prime phase. These two phases are stable phases, and do not coarsen or transform into other phases when aging is carried out. Therefore, the two phases heavily contribute to the increase in yield strength following T6 heat treatment. The GP zone phase, the S prime phase, and the theta prime phase also contribute to strength enhancement, but, being metastable phases, have the problem of coarsening or inducing transformation into other phases when heat treated.

As described above, it was confirmed via analyses and experiments that Cu, Mg, and Zn are the elements which affect the fractions of the T prime phase, the Eta prime phase, the GP zone phase, the S prime phase, and the Theta prime phase, and it was confirmed that the fractions of these metastable phases can be controlled by specifying the compositions of these elements.

Meanwhile, a wrought aluminum alloy provided as another embodiment of the present disclosure may be composed of 5.5 to 6.0 wt % of Zn; 2.0 to 2.5 wt % of Mg; 0.2 to 0.6 wt % of Cu; 0.1 to 0.2 wt % of Cr; at most 0.2 wt % (and more than 0 wt %) of Fe; at most 0.2 wt % (and more than 0 wt %) of Mn; at most 0.2 wt % (and more than 0 wt %) of Si; and at most 0.1 wt % (and more than 0 wt %) of Ti; with the remainder being unavoidable impurities and Al.

It was confirmed via analyses and experiments that Cu, Mg, and Zn are also the elements which affect the fractions of the T prime phase, the Eta prime phase, the GP zone phase, the S prime phase, and the Theta prime phase in this alloy, and it was confirmed that the fractions of these metastable phases can be fundamentally controlled by specifying the compositions of these elements to within the above ranges.

A wrought aluminum alloy provided as still another embodiment of the present disclosure is composed of 5.5 to 6.0 wt % of Zn; 2.0 to 2.5 wt % of Mg; 0.2 to 0.6 wt % of Cu; 0.1 to 0.2 wt % of Cr; at most 0.2 wt % (and more than 0 wt %) of Fe; at most 0.2 wt % (and more than 0 wt %) of Mn; at most 0.2 wt % (and more than 0 wt %) of Si; at most 0.1 wt % (and more than 0 wt %) of Ti; at most 0.05 wt % (and more than 0 wt %) of Sr; and 0.1 to 0.8 wt % of Ag; with the remainder being Al.

The wrought aluminum alloy according to the same exhibited a yield strength of about 208 MPa, a tensile strength of about 350 MPa, an elongation of about 12.9% when F-tempered, and exhibited a yield strength of about 573 MPa, a tensile strength of about 618 MPa, and an elongation of about 10.9% when T6 heat treated.

Figure 33:
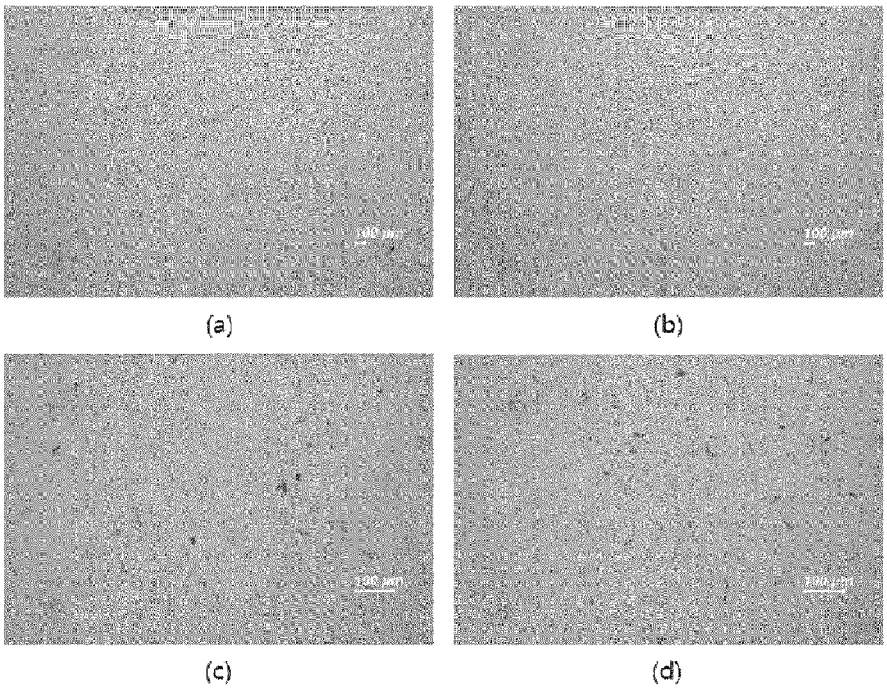
FIG. 33 is a photograph showing the microstructure of a wrought aluminum alloy according to another embodiment of the present disclosure.

FIG. 33 is a photograph showing the microstructure of a wrought aluminum alloy according to still another embodiment of the present disclosure In FIG. 33, (a) shows the microstructure of an extrusion product of the above-described wrought aluminum alloy according to still another embodiment of the present disclosure at low magnification (×50) following F-tempering, (b) shows the microstructure of an extrusion product of the above-described wrought aluminum alloy according to still another embodiment of the present disclosure at high magnification (×200) following F-tempering, (c) shows the microstructure of an extrusion product of the above-described wrought aluminum alloy according to still another embodiment of the present disclosure at low magnification (×50) following T6 heat treatment, and (d) shows the microstructure of an extrusion product of the above-described wrought aluminum alloy according to still another embodiment of the present disclosure at high magnification (×200) following T6 heat treatment.

It was observed that in the above-described wrought aluminum alloy according to still another embodiment of the present disclosure, edge tearing phenomena was not exhibited even when the extrusion speed is 1.4 mm/s. Moreover, it was observed that deformation does not occur even when press water quenching (PWQ) is performed.

Hereinafter, still another alloying element (Ag) controlling extrudability in a wrought aluminum alloy according to still another embodiment of the present disclosure is examined, and the reasons for specifying the composition range of Ag is explained along with experimental examples, in order to facilitate understanding of the present disclosure. However, the experimental examples below are merely for facilitating understanding of the present disclosure, and the present disclosure is not limited to the experimental examples described below.

Figure 34:
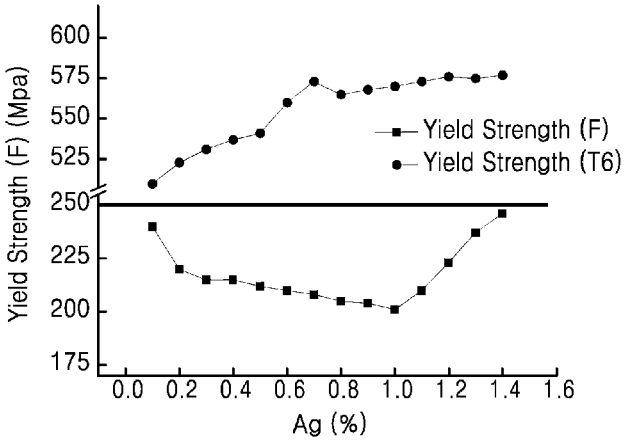
FIG. 34 is a graph of experimentally measured yield strength according to Ag content of a wrought aluminum alloy according to an experimental example of the present disclosure.
Figure 35:
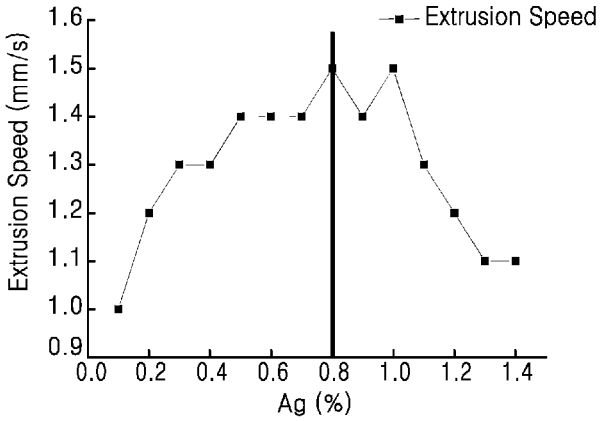
FIG. 35 is a graph of experimentally measured change in extrusion speed according to Ag content in a wrought aluminum alloy according to an experimental example of the present disclosure.

FIG. 34 is a graph of experimentally measured yield strength according to Ag content of a wrought aluminum alloy according to an experimental example of the present disclosure, and FIG. 35 is a graph of experimentally measured change in extrusion speed according to Ag content in a wrought aluminum alloy according to an experimental example of the present disclosure A wrought aluminum alloy according to the experimental example may be an alloy in which the composition of Ag is arbitrarily varied, and is composed of 5.5 to 6.0 wt % of Zn; 2.0 to 2.5 wt % of Mg; 0.2 to 0.6 wt % of Cu; 0.1 to 0.2 wt % of Cr; at most 0.2 wt % (and more than 0 wt %) of Fe; at most 0.2 wt % (and more than 0 wt %) of Mn; at most 0.2 wt % (and more than 0 wt %) of Si; at most 0.1 wt % (and more than 0 wt %) of Ti; and at most 0.05 wt % (and more than 0 wt %) of Sr; with the remainder being Al. Specifically, the alloy may be composed of 0.15 wt % of Cr, 0.6 wt % of Cu, 0.1 wt % of Fe, 2.25 wt % of Mg, 0.1 wt % of Mn, 0.1 wt % of Si, 0.01 wt % of Sr, 0.05 wt % of Ti, and 5.5 wt % of Zn, with the remainder being Al.

Referring to FIG. 34, it is analyzed that when Ag is added to the wrought aluminum alloy according to an embodiment of the present disclosure described above with reference to FIG. 2, the yield strength following heat treatment continuously increases, while conversely, the yield strength prior to heat treatment is maintained at or below 250 MPa. Starting from an Ag content of 1 wt %, the yield strength prior to heat treatment again increases with Ag content, and thus it is determined that it is appropriate to limit Ag to 1 wt % or lower in view of yield strength. Referring to FIG. 35, since it is advantageous to limit Ag content to 1 wt % or lower in view of yield strength and advantageous to limit Ag content to 0.8 wt % or lower in view of cost, in the experimental example, it may be appropriate to specify an Ag content of 0.1 to 0.8 wt % in view of extrudability enhancement and yield strength.

Table 6 displays the change in yield strength and extrusion speed according to Ag content, of wrought aluminum alloys according to the experimental example of the present disclosure.

TABLE 6

| Ag Content | Yield strength F (MPa) | Yield strength T6 (MPa) | Extrusion speed (mm/s) |
|---|---|---|---|
| 0.1 | 240 | 510 | 1.0 |
| 0.2 | 220 | 523 | 1.2 |
| 0.3 | 215 | 531 | 1.3 |
| 0.4 | 215 | 537 | 1.3 |
| 0.5 | 212 | 541 | 1.4 |
| 0.6 | 210 | 560 | 1.4 |

TABLE 6-continued

| Ag Content | Yield strength F (MPa) | Yield strength T6 (MPa) | Extrusion speed (mm/s) |
|---|---|---|---|
| 0.7 | 208 | 573 | 1.4 |
| 0.8 | 205 | 565 | 1.5 |
| 0.9 | 204 | 568 | 1.4 |
| 1.0 | 201 | 570 | 1.5 |
| 1.1 | 210 | 573 | 1.3 |
| 1.2 | 223 | 576 | 1.2 |
| 1.3 | 237 | 575 | 1.1 |
| 1.4 | 246 | 577 | 1.1 |

Referring to and thereby summarizing Table 6, it is observed that when Ag is added to the wrought aluminum alloy according to an embodiment of the present disclosure described above with reference to FIG. 3, although there is little effect up to 0.1 wt % in view of both yield strength and extrusion speed, yield strength following T6 heat treatment continuously increases with the addition of 0.2-1.4 wt % of Ag, and extrusion speed continuously increases until reaching 1.5 mm/s with the addition of 0.2-1.0 wt % of Ag, but decreases starting from 1.1 wt % of Ag. In view of strength following T6 heat treatment, it is advantageous to increase the Ag content, but when considering both cost and extrudability, it is desirable to specify an Ag content of 0.2 to 1.0 wt %.

Up to now, various embodiments have been described of an aluminum alloy, which is a 7000 series alloy having a yield strength of at least 500 MPa and a level of productivity achieved by an extrusion speed of at least 1 mm/s, and which is not deformed when subjected to solution treatment and PWQ treatment.

Figure 36:
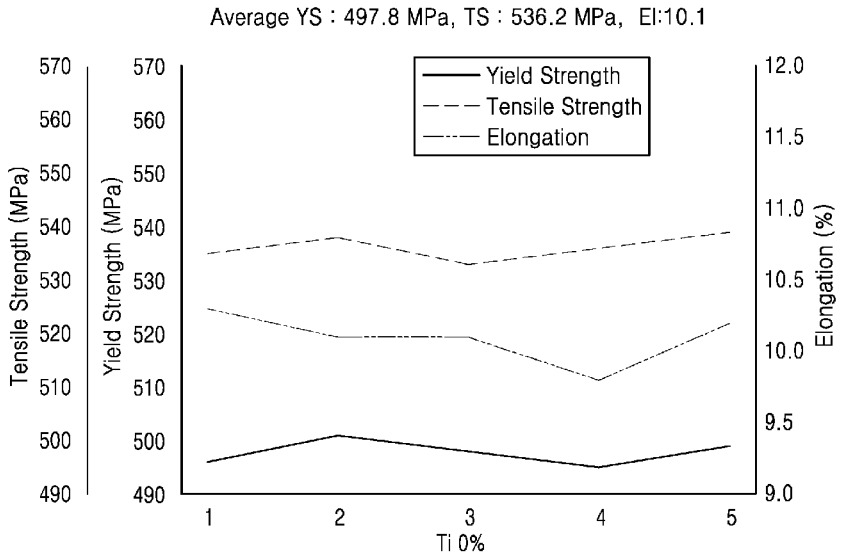
FIG. 36 is a graph of measured strength and elongation of a wrought aluminum alloy according to an embodiment of the present disclosure, when Ti is not added.

Phases that improved mechanical properties following T6 heat treatment in existing A7075 are phases such as θ', S', η', T', and GP zones. Among these, GP zones, θ', and S', although contributing to strength enhancement, have the problem of coarsening in order to be transformed into a stable phase, and of deforming. However, in the present disclosure, among the phases contributing to strength enhancement, the fractions of GP zones, θ', and S', which cause deformation, are reduced, and the fractions of phases, such as η and T, which are not significantly modified thermally, are kept stable. In addition, maximization of yield strength and tensile strength was achieved by adding small amounts of Ag, which does not significantly react with Zn, Mg, and Cu, which are major additive elements to 7000 series alloys which do not experience changes in extrusion speed and thermal deformation, and can contribute to strength enhancement by forming an Al—Ag Beta phase. FIG. 36 is a graph of measured strength and elongation of a wrought aluminum alloy according to an embodiment of the present disclosure, when Ti is not added, FIG. 37 is a graph of measured strength and elongation of a wrought aluminum alloy according to an embodiment of the present disclosure, when 0.1 wt % of Ti is added, and FIG. 38 is a graph of measured change in mechanical properties according to amount of Ti added in a wrought aluminum alloy according to an embodiment of the present disclosure.

Figure 37:
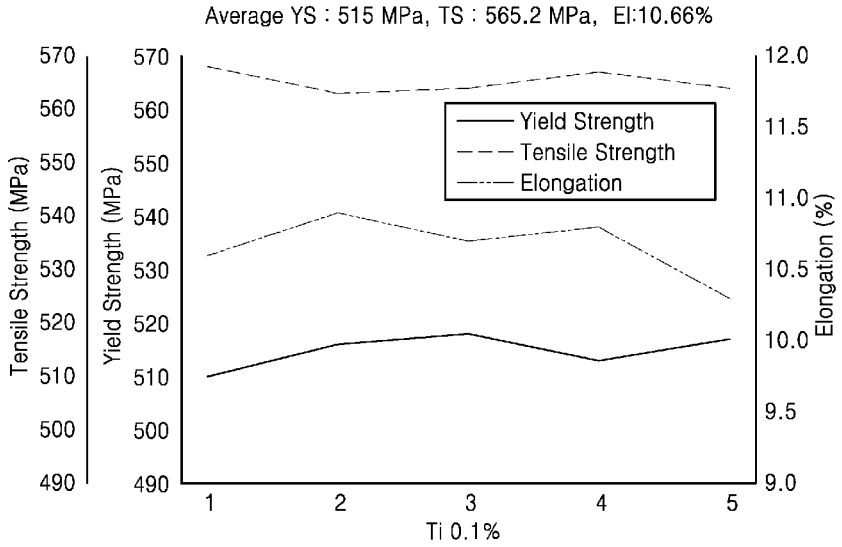
FIG. 37 is a graph of measured strength and elongation of a wrought aluminum alloy according to an embodiment of the present disclosure, when 0.1 wt % of Ti is added.

Referring to FIGS. 36 and 37, although adding about 0.1 wt % of Ti does not significantly improve mechanical properties, there is an effect of increasing yield strength, tensile strength, and elongation by about 4 to 5% through a grain-refining role. The effect is exhibited for a Ti content of 0.01 to 0.15 wt %, specifically, 0.05 to 0.1 wt %. The effect is negligible below this range, and is not significantly different above this range.

Figure 38:
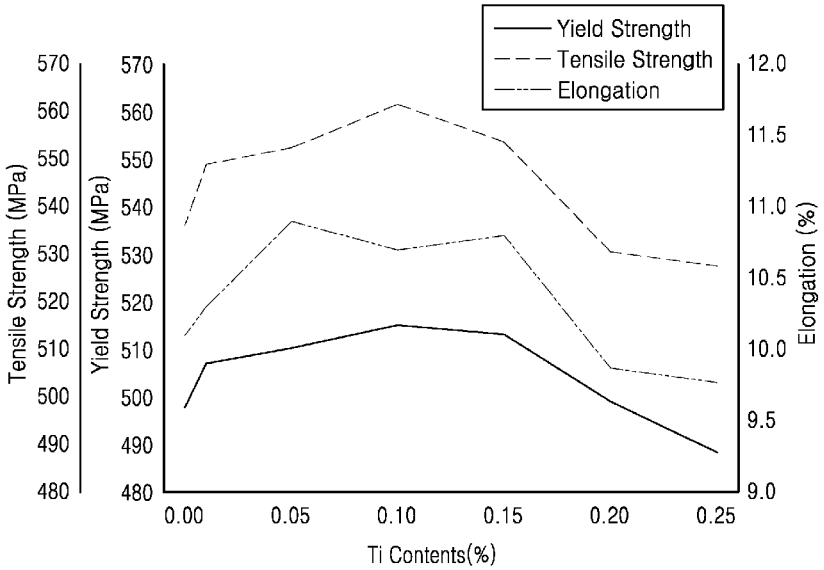
FIG. 38 is a graph of measured change in mechanical properties according to amount of Ti added in a wrought aluminum alloy according to an embodiment of the present disclosure.

Referring to FIG. 38, changes in the mechanical properties was evaluated by varying Ti content from 0%, 0.01%, 0.05%, 0.1%, 0.15%, 0.2%, to 0.25%. The results of the evaluation showed that although the trend according to content is not a completely linear increase, there is an effect from 0.01% to 0.15%.

Figure 39:
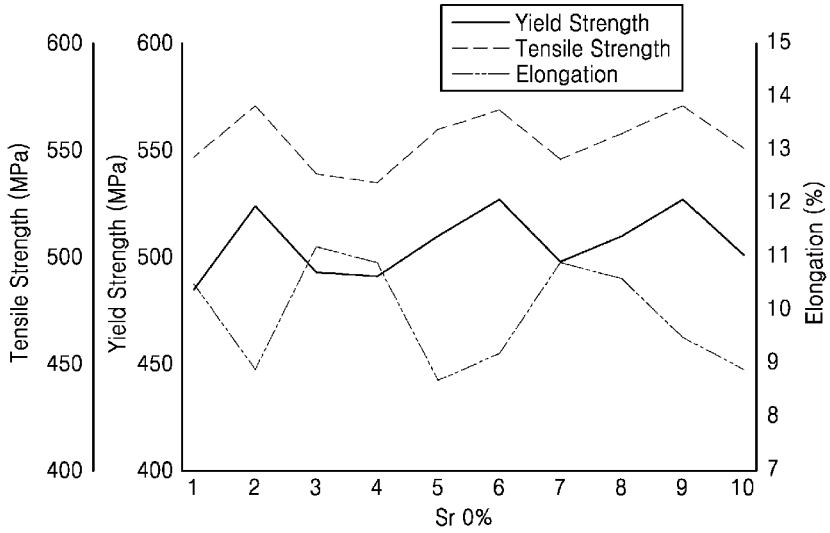
FIG. 39 is a graph of measured strength and elongation of a wrought aluminum alloy according to an embodiment of the present disclosure, when Sr is not added.
Figure 40:
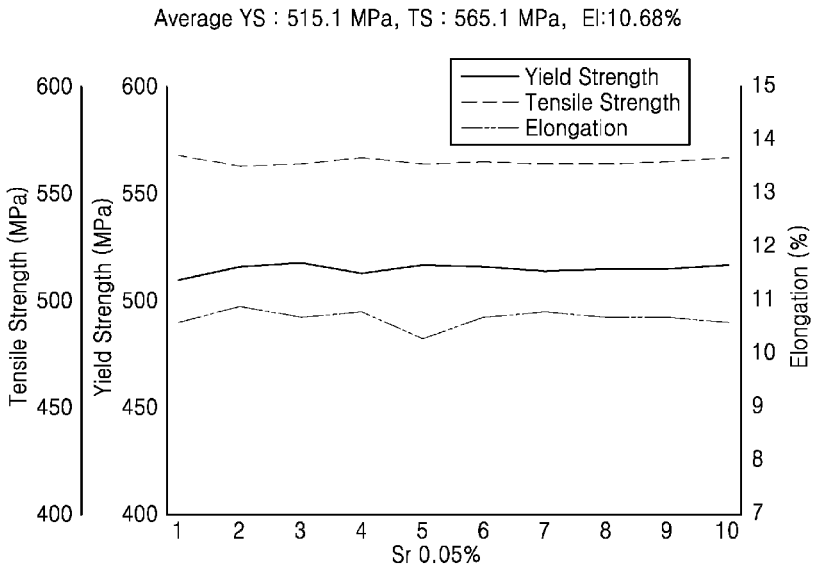
FIG. 40 is a graph of measured strength and elongation of a wrought aluminum alloy according to an embodiment of the present disclosure, when 0.05 wt % of Sr is added.
Figure 41:
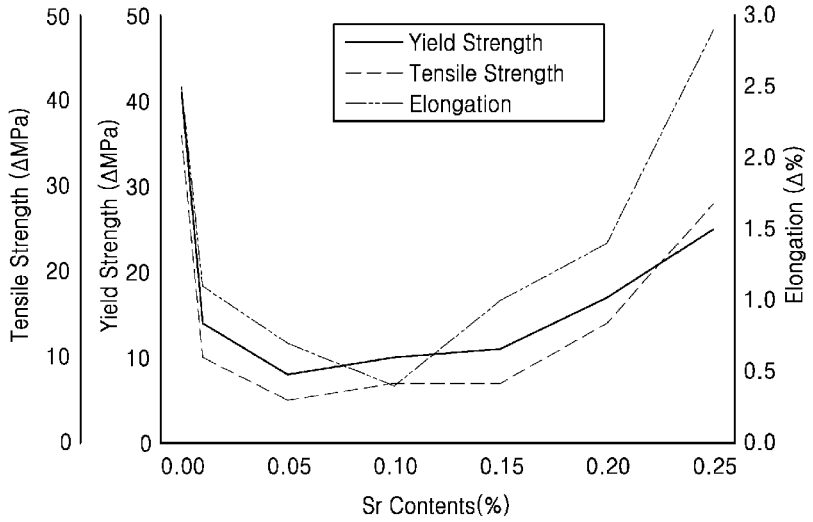
FIG. 41 is a graph of measured change in mechanical properties according to amount of Sr added in a wrought aluminum alloy according to an embodiment of the present disclosure.

FIG. 39 is a graph of measured strength and elongation of a wrought aluminum alloy according to an embodiment of the present disclosure, when Sr is not added, FIG. 40 is a graph of measured strength and elongation of a wrought aluminum alloy according to an embodiment of the present disclosure, when 0.05 wt % of Sr is added, and FIG. 41 is a graph of measured change in mechanical properties according to amount of Sr added in a wrought aluminum alloy according to an embodiment of the present disclosure.

Referring to FIGS. 39 and 40, although Sr is known as an alloying element having a eutectic Si-refining role in a eutectic silicon composition, in the present disclosure, when Sr is added to an alloy having a Mg content of at least 1.5 wt %, although the contribution to improving the mechanical properties is not large, a characteristic was observed in which uniform mechanical properties are achieved in the alloy. In the present disclosure also, the limitation of variation in properties may be overcome adding 0.05%, and the same characteristic was observed in evaluations examining mass producibility.

Referring to FIG. 41, when Sr contents of 0%, 0.01%, 0.05%, 0.1%, 0.15%, 0.2%, 0.25% are specified and added in an evaluation for specifying Sr content, the variation in mechanical properties is most desirable when the Sr content is 0.05 to 0.1 wt %, and this effect is maintained up to 0.2 wt %, but was observed to disappear when 0.2 wt % was exceeded. Thus, it is desirable to specify 0.01 to 0.2 wt % of Sr.

Up to now, various embodiments have been described of an aluminum alloy, which is a 7000 series alloy having a yield strength of at least 500 MPa and a level of productivity achieved by an extrusion speed of at least 1 mm/s, and which is not deformed when subjected to solution treatment and PWQ treatment.

Phases that improved mechanical properties following T6 heat treatment in existing A7075 are phases such as θ', S', η', T', and GP zones. Among these, GP zones, θ', and S', although contributing to strength enhancement, have the problem, when solution heat treated, of coarsening in order to be transformed into a stable phase, and deforming. However, in the present disclosure, among the phases contributing to strength enhancement, the fractions of GP zones, θ', and S', which cause deformation when heat treatment is performed, are reduced, and the fractions of phases, such as η' and T, which are not significantly modified thermally, are kept stable.

The above-described alloys of the present disclosure enable the extrusion speed of 7000 series wrought aluminum alloys to be 1 mm/s or higher, which is at least 5 times higher than conventional A7075 alloys. Moreover, the alloys of the present disclosure are not deformed when subjected to solution treatment and PWQ, have a yield strength of at least 500 MPa, have excellent properties with respect to surface treatments such as anodization, and may not only be used as a structural material, for instance, as a material for automobile body and chassis parts, but may also be used as a case material for smartphones and IT components.

According to some embodiments of the present disclosure, a wrought aluminum alloy may be achieved, which is a 7000 series aluminum alloy having a yield strength of at least 500 MPa and capable of achieving an extrusion speed of at least 1 mm/s, and which is not deformed when subjected to solution treatment and press water quenching (PWQ). The scope of the present disclosure is not limited by such effects.

Although the present disclosure has been described with reference to specific embodiments illustrated in the drawings, these embodiments are merely exemplary. Therefore, it will be readily understood by those skilled in the art that various modifications and other equivalent embodiments are possible. Thus, the true technical scope of the present disclosure is defined by the appended claims.

What is claimed is:

1. A wrought aluminum alloy comprising:
5.5 to 6.0 wt % of Zn;
2.0 to 2.5 wt % of Mg;
0.2 to 0.6 wt % of Cu;
0.1 to 0.2 wt % of Cr;
at most 0.2 wt % (and more than 0 wt %) of Fe;
at most 0.2 wt % (and more than 0 wt %) of Mn;
at most 0.2 wt % (and more than 0 wt %) of Si;
at most 0.1 wt % (and more than 0 wt %) of Ti;
at most 0.05 wt % (and more than 0 wt %) of Sr; and
more than 0.5 wt % but not more than 0.8 wt % of Ag, with the remainder being Al wherein extrusion is possible at an extrusion speed in the range of 1.2 mm/s to 1.5 mm/s, and wherein the yield strength is greater than 523 MPa but not greater than 565 MPa when T6 heat treatment is performed after the extrusion.

2. The wrought aluminum alloy of claim 1, wherein the wrought aluminum alloy comprises 0.4 to 0.6 wt % of Cu.

3. The wrought aluminum alloy of claim 1, wherein the wrought aluminum alloy comprises 2.0 to 2.25 wt % of Mg.

4. An automobile bumper comprising, as a material, the wrought aluminum alloy according to claim 1.

5. A structural material comprising, as a material, the wrought aluminum alloy according to claim 1.

6. A smartphone case comprising, as a material, the wrought aluminum alloy according to claim 1.

7. A wrought aluminum alloy comprising:
0.01 to 0.15 wt % of Ti;
0.01 to 0.2 wt % of Sr;
5.5 to 6.0 wt % of Zn;
more than 2.0 wt % but not more than 2.25 wt % of Mg;
0.4 to 0.8 wt % of Cu;
0.1 to 0.2 wt % of Cr;
at most 0.2 wt % (and more than 0 wt %) of Fe;
at most 0.2 wt % (and more than 0 wt %) of Mn; and
at most 0.2 wt % (and more than 0 wt %) of Si, with the remainder being Al, wherein a change in volume change ratio along the solidus is in the range of 0.11% to 0.27%,
wherein extrusion is possible at an extrusion speed in the range of 1.0 mm/s to 1.4 mm/s, and wherein the yield strength is greater than 508 MPa but not greater than 515 MPa when T6 heat treatment is performed after the extrusion.

8. A wrought aluminum alloy comprising:
0.01 to 0.15 wt % of Ti;
5.5 to 6.0 wt % of Zn;
more than 2.0 wt % but not more than 2.25 wt % of Mg;
0.4 to 0.8 wt % of Cu;
0.1 to 0.2 wt % of Cr;
at most 0.2 wt % (and more than 0 wt %) of Fe;
at most 0.2 wt % (and more than 0 wt %) of Mn; and
at most 0.2 wt % (and more than 0 wt %) of Si, with the remainder being Al,
wherein a change in volume change ratio along the solidus is in the range of 0.11% to 0.27%, wherein extrusion is possible at an extrusion speed in the range of 1.0 mm/s to 1.4 mm/s, and wherein the yield strength is greater than 508 MPa but not greater than 515 MPa when T6 heat treatment is performed after the extrusion.

9. An automobile bumper comprising, as a material, the wrought aluminum alloy according to claim 7.

10. A structural material comprising, as a material, the wrought aluminum alloy according to claim 7.

11. A smartphone case comprising, as a material, the wrought aluminum alloy according to claim 7.

* * * * *